US006180302B1

(12) United States Patent
Tanaka et al.

(10) Patent No.: US 6,180,302 B1
(45) Date of Patent: Jan. 30, 2001

(54) ELECTROPHOTOGRAPHIC PHOTOSENSITIVE MEMBER, AND PROCESS CARTRIDGE AND ELECTROPHOTOGRAPHIC APPARATUS PROVIDED WITH THE ELECTROPHOTOGRAPHIC MEMBER

(75) Inventors: Takakazu Tanaka, Numazi; Hideki Anayama; Tetsuro Fukui, both of Yokohama; Hidetoshi Hirano, Shizuoka, all of (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/178,742

(22) Filed: Oct. 27, 1998

(30) Foreign Application Priority Data

Oct. 27, 1997 (JP) ..... 9-294476

(51) Int. Cl.[7] ..... G03G 5/047; G03G 5/147

(52) U.S. Cl. ..... 430/59.6; 430/66; 430/96; 399/111; 399/159

(58) Field of Search ..... 430/59.1, 59.6, 430/66, 96; 399/159, 111

(56) References Cited

U.S. PATENT DOCUMENTS

| | | | | |
|---|---|---|---|---|
| 3,837,851 | | 9/1974 | Shattuck et al. | 96/1.5 |
| 3,871,880 | | 3/1975 | Montillier | 96/1.5 |
| 5,008,706 | * | 4/1991 | Ohmori et al. | 355/219 |
| 5,363,176 | * | 11/1994 | Ishihara et al. | 355/219 |
| 5,565,961 | * | 10/1996 | Shoji et al. | 355/200 |
| 5,654,118 | * | 8/1997 | Yuh et al. | 430/58 |
| 5,968,674 | * | 10/1999 | Hsieh et al. | 430/59 |

FOREIGN PATENT DOCUMENTS

| | | |
|---|---|---|
| 56-167759 | 12/1981 | (JP) . |
| 57-017826 | 1/1982 | (JP) . |
| 57-019576 | 2/1982 | (JP) . |
| 58-040566 | 3/1983 | (JP) . |
| 61-228453 | 10/1986 | (JP) . |
| 61-272754 | 12/1986 | (JP) . |
| 63-149668 | 6/1988 | (JP) . |
| 63-293548 * | 11/1988 | (JP) . |
| 6-214407 * | 8/1994 | (JP) . |

OTHER PUBLICATIONS

Chemical Abstracts 110:144958 Nov. 1988.*
Chemical Abstracts 122:118931 Aug. 1994.*
Borsenberger, Paul M. et al. Organic Photoreceptors for Imaging Systems 1993.*

* cited by examiner

*Primary Examiner*—Christopher D. Rodee
(74) *Attorney, Agent, or Firm*—Fitzpatrick, Cella, Harper & Scinto

(57) ABSTRACT

The present invention includes an electrophotographic photosensitive member having a surface layer containing a polyphenylene resin, and a process cartridge and an electrophotographic apparatus both having the electrophotographic photosensitive member.

21 Claims, 1 Drawing Sheet

FIGURE
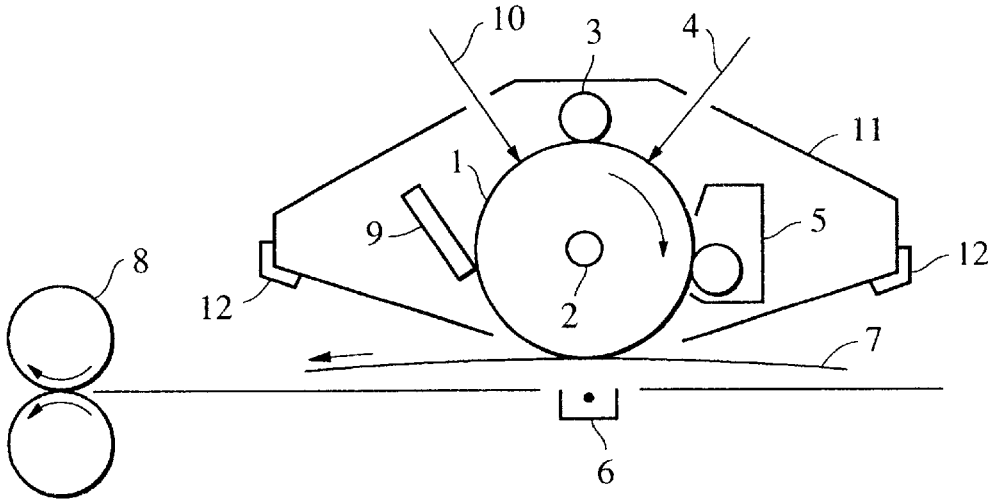

ELECTROPHOTOGRAPHIC PHOTOSENSITIVE MEMBER, AND PROCESS CARTRIDGE AND ELECTROPHOTOGRAPHIC APPARATUS PROVIDED WITH THE ELECTROPHOTOGRAPHIC MEMBER

BACKGROUND OF THE INVENTION

1. Field of the Invention

The present invention relates to an electrophotographic photosensitive member, and a process cartridge and an electrophotographic apparatus provided with the electrophotographic photosensitive member. In more detail, the present invention relates to an electrophotographic photosensitive member having a surface layer containing a specified resin, and a process cartridge and an electrophotographic apparatus provided with the electrophotographic photosensitive member.

2. Description of the Related Art

Electrophotographic photosensitive members (OPC photosensitive members) containing organic photoconductive compounds have been aggressively developed in the recent years. For example, U.S. Pat. No. 3,837,851 discloses a photosensitive member provided with a charge transfer layer containing triarylpyrazoline, while U.S. Pat. No. 3,871,880 discloses a photosensitive member provided with a charge generation layer containing perylene pigment derivatives and a charge transfer layer containing condensates of 3-propylene and formaldehyde.

Each of the organic photoconductive compounds has a different photosensitive wavelength region depending on the species of the compound. For example, Japanese Patent Laid-Open Nos. 61-272754 and 56-167759 disclose azo pigments having a high sensitivity in the visible region and Japanese Patent Laid-Open Nos. 57-19576 and 61-228453 disclose compounds having a high sensitivity in the infrared region.

Among these compounds, those having a high sensitivity in the infrared region have been used for laser beam printers and LED printers.

Meanwhile, the electrophotographic photosensitive member is naturally required to possess a proper sensitivity, electrical characteristic and mechanical characteristic in addition to optical characteristic to comply with the applied electrophotographic process.

Especially, since electrical and mechanical stresses are directly and repeatedly impressed to the electrophotographic photosensitive member for repeated use, durabilities against these stresses are also required.

For example, durabilities against chemical deterioration by ozone and nitrogen oxides generated during charging or against electrical and mechanical degradation such as surface abrasion and flaw caused by discharge and cleaning are required.

The OPC photosensitive member is in particular composed of a substance so soft as compared with inorganic photosensitive members that durability against mechanical degradation is especially needed.

The foregoing problems evidently occurs in the contact charging method being developed as a leading technology in recent years and disclosed in Japanese Patent Laid-Open Nos. 57-17826 and 58-40566, wherein the electrophotographic photosensitive member is charged by impressing a voltage on a charging member disposed in direct contact with the electrophotographic photosensitive member. This contact charging method has several advantages such as generating extremely small amounts of ozone as compared with scorotrons or being very economical without waste electricity in contrast to scorotrons in which about 80% of the current fed to a charger flows through the shield.

However, an improved mechanical strength is required for the electrophotographic photosensitive member because the charging member makes a direct contact with the electrophotographic photosensitive member. It is proposed, on the other hand, to use a voltage in which a direct current (DC) voltage is superimposed on an alternating current (AC) voltage as an impressed voltage in order to improve charging stability since the contact charging method also depends on charging by discharge (Japanese Patent Laid-Open No. 63-149668).

Although this charging method enables one to improve charging stability, use of the AC voltage increases the amount of electric current flowing through the electrophotographic photosensitive member. Accordingly, the amount of abrasion of the electrophotographic photosensitive member may increase. As hitherto described, not only mechanical strength but also electrical strength, along with durability against solvent cracks caused by adhesion of a mechanical oil and hand grease, are required for the electrophotographic photosensitive member.

SUMMARY OF THE INVENTION

The object of the present invention is to provide an electrophotographic photosensitive member having excellent mechanical durability and electrical durability and having an excellent solvent crack resistance.

Another object of the present invention is to provide a process cartridge and an electrophotographic apparatus equipped with the electrophotographic photosensitive member described above.

Accordingly, the present invention provides an electrophotographic photosensitive member comprising a substrate, a photosensitive layer formed thereon, and a surface layer of the electrophotographic photosensitive member containing a polyphenylene resin.

The present invention also provides a process cartridge and an electrophotographic apparatus equipped with the electrophotographic photosensitive member described above.

BRIEF DESCRIPTION OF THE DRAWING

The FIGURE is an example of an illustrative construction of the electrophotographic apparatus equipped with a process cartridge having an electrophotographic photosensitive member according to the present invention.

DETAILED DESCRIPTION OF THE INVENTION

The electrophotographic photosensitive member according to the present invention has a photosensitive layer on a supporting member, and therein a surface layer of the electrophotographic photosensitive member contains a polyphenylene resin.

The polyphenylene resin used in the present invention is a resin having a phenylene group, which may have a variety of organic groups substituted thereon, in the polymer main chain as a repeating structural unit.

The polyphenylene resin used in the present invention has a high crystallinity owing to the polyphenylene structure of the main chain, so that a high mechanical strength is obtained in forming a polymer film resulting from its rigid structure. The resin has a high electrical strength because the resin contains a conjugate system expanding over a wide range.

It is preferable that the polyphenylene resin has a structural unit represented by the following formula (1) in view of its electrophotographic characteristics and solubility:

(1)

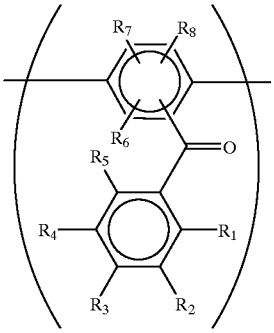

wherein $R_1$ to $R_5$ are the same or different and are each a hydrogen atom, a fluorine atom or a substituted or unsubstituted alkyl group, and $R_6$ to $R_8$ are the same or different and are each a hydrogen atom or a substituted or unsubstituted alkyl group.

Examples of the alkyl groups in the formula (1) include methyl group, ethyl group, propyl group, isopropyl group, butyl group, t-butyl group, hexyl group and octyl group. Possible substituent groups for the alkyl groups are fluorine atom, alkyl groups such as methyl group, ethyl group, propyl group, isopropyl group, butyl group, t-butyl group, hexyl group and octyl group and aryl groups such as phenyl group and naphthyl group.

It is preferable in the present invention that all of $R_6$ to $R_8$, especially all of $R_1$ to $R_8$, are hydrogen atoms in view of mechanical strength.

Two or more kinds of the structural units represented by the formula (1) may be contained in the polyphenylene resin according to the present invention.

The polyphenylene resin may contain a structural unit other than that represented by the formula (1). In this case, the structural unit represented by the formula (1) preferably accounts for 20 mol % or more of the total structural units, the ratio of 40 mol % or more being especially preferable.

It is especially preferable in view of its solubility that the polyphenylene resin has the structural unit represented by the following formula (2):

(2)

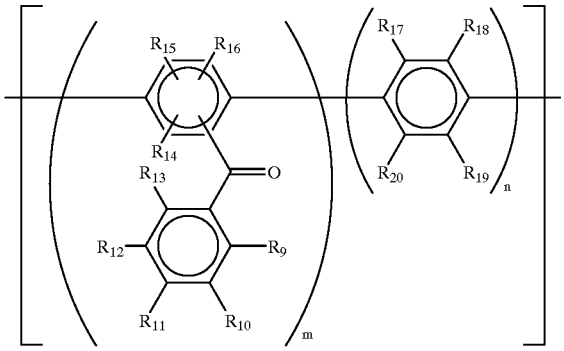

wherein $R_9$ to $R_{13}$ are the same or different and are each a hydrogen atom, a fluorine atom or a substituted or unsubstituted alkyl group, $R_{14}$ to $R_{20}$ are the same or different and are each a hydrogen atom or a substituted or unsubstituted alkyl group and m and n represent copolymerization ratios.

The alkyl groups and the substituent groups for the alkyl groups in formula (2) are similar to those of formula (1).

According to the present invention, all of $R_{14}$ to $R_{20}$, especially all of $R_9$ to $R_{20}$, are preferably hydrogen atoms in view of the strength of the resin. The ratio m:n is preferably in the range of 20:80 to 80:20 and the ratio of 40:60 to 60:40 is especially preferable.

It is preferable that the polyphenylene resin according to the present invention has a weight average molecular weight (Mw) of 10,000 to 500,000.

Other resins such as a polycarbonate resin or polyarylate resin may be used by mixing with the polyphenylene resin in the present invention. It is preferable in this case that the polyphenylene resin according to the present invention is present in amounts of 20% by weight or more, especially 60% by weight or more.

Though preferable examples of the structural units or repeating units to be contained in the polyphenylene resin according to the present invention are listed hereinafter, the present invention is by no means limited to these examples.

Structural unit (1)

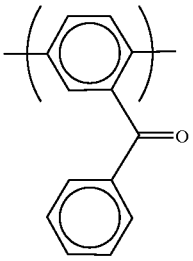

-continued
Structural unit (2)
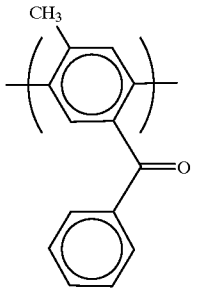
Structural unit (3)
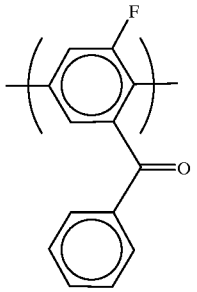
Structural unit (4)
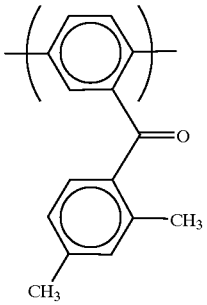
Structural unit (5)
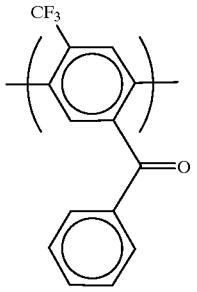
Structural unit (6)
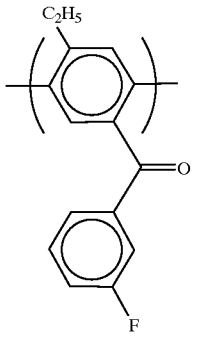
-continued
Structural unit (7)
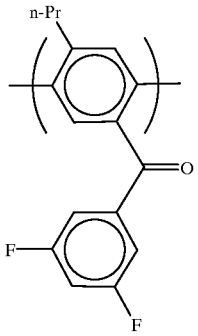
Structural unit (8)
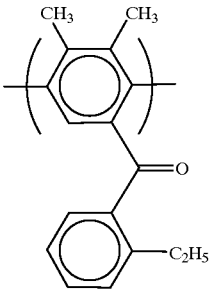
Structural unit (9)
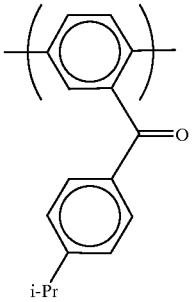
Structural unit (10)
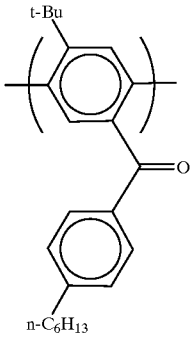

-continued
Structural unit (11)
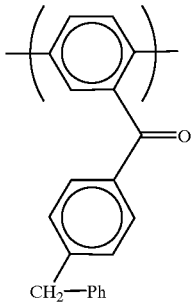
Structural unit (12)
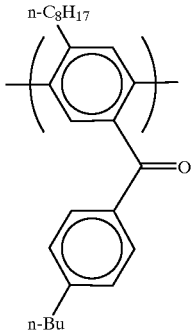
Structural unit (13)
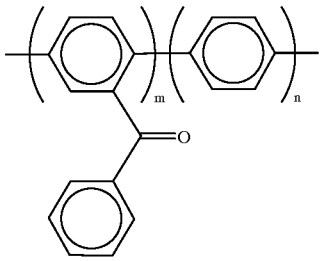
Structural unit (14)
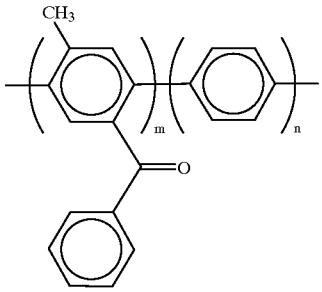
Structural unit (15)
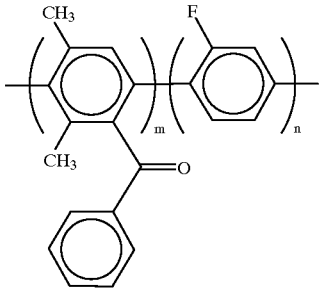
-continued
Structural unit (16)
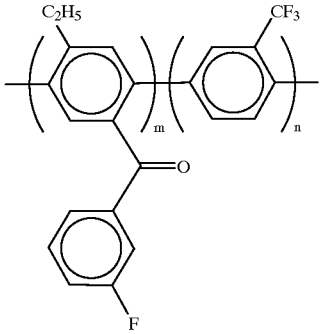
Structural unit (17)
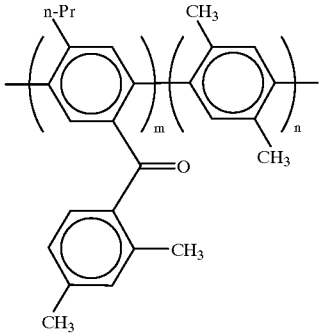
Structural unit (18)
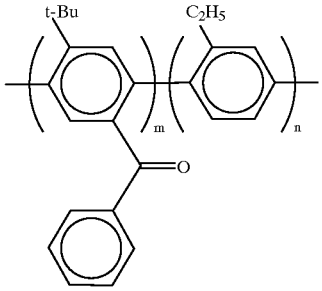
Structural unit (19)
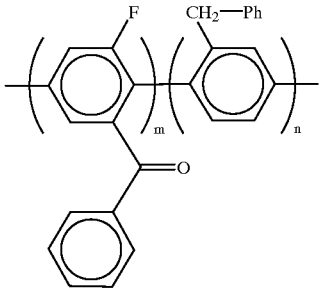

-continued

Structural unit (20)

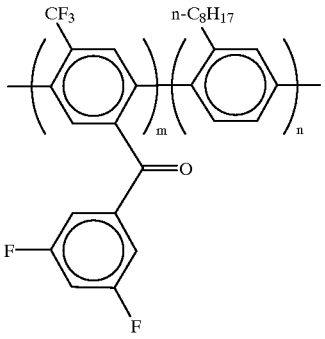

The structural units, of the structural units (1) and (13) are especially preferable.

Synthesis Example 1

(Synthesis of a Polyphenylene Resin Having the Structural Unit (1))

A solution containing 2.5 g (0.01 mol) of 2,5-dichlorobenzophenone in 30 ml of tetrahydrofuran was added to a solution containing 1.3 g (0.02 mol) of zinc powder in 10 ml of tetrahydrofuran under a stream of argon.

After stirring the mixture for 1 hour, 0.05 g (0.18 mmol) of $NiCl_2$-bipyridine was added and the mixed solution was refluxed for 24 hours. After cooling, the reaction solution was poured into 200 ml of ethanol and the precipitate (the polymer synthesized) was filtered off. The reaction yield after drying was 1.4 g (yield ratio: 77.7%).

Synthesis Example 1

(Synthesis of a Polyphenylene Resin Having the Example of the Structural Unit (13))

A solution containing 2.5 g (0.01 mol) of 2,5-dichlorobenzophenone and 1.5 g (0.01 mol) of 1,4-dichlorobenzene in 30 ml of tetrahydrofuran was added to a solution containing 2.6 g (0.04 mol) of zinc powder in 20 ml of tetrahydrofuran under a stream of argon.

After stirring the mixture for 1 hour, 0.10 g (0.36 mmol) of $NiCl_2$-bipyridine was added and the mixed solution was refluxed for 24 hours. After cooling, the reaction solution was poured into 300 ml of ethanol and the precipitate (the polymer synthesized) was filtered off. The reaction yield after drying was 2.2 g (yield ratio: 85.9%).

The polyphenylene resins having structural units other than those described above can be obtained by similar methods.

The surface layer of the electrophotographic photosensitive member according to the present invention can be mainly classified into two groups of photosensitive layers and protective layers on the photosensitive layers.

When the photosensitive layer is of a monolayer type containing a charge generating material and charge transfer material in the same layer, the monolayer serves as a surface layer as well as a photosensitive layer.

When the photosensitive Layer is composed of a lamination type layer in which a charge transfer layer containing a charge transfer material is coated on a charge generating layer containing a charge generating material, the charge transfer layer serves as a surface layer while, conversely, the charge generating layer serves as a surface layer when the charge generating layer forms a top layer.

It is preferable in the present invention that the charge transfer layer serves as a surface layer in view of the electrophotographic characteristics.

The charge transfer layer can be formed by coating followed by drying, a solution in which the charge transfer material and a binder resin are dissolved in a solvent. The applicable charge transfer materials include triarylamine compounds, hydrazone compounds, stilbene compounds, pyrazoline based compounds, oxazole compounds, triarylmethane compounds and thiazole compounds. The polyphenylene resins according to the present invention are used for the binder resin when the charge transfer layer serves the surface layer. When the charge transfer layer does not serve as the surface layer, various kinds of resins are used as the binder resin. The weight ratio between the charge transfer material and the binder resin is preferably in the range of 1:0.5 to 1:2. The preferable thickness of the charge transfer layer is 5 to 40 $\mu$m, with the thickness of 15 to 30 $\mu$m being more preferable.

The charge generating layer can be formed by coating, followed by drying, a dispersion solution prepared by thoroughly dispersing the charge generating material with 0.3 to 4 times larger weight of binder resin and solvent using a homogenizer, ultrasonic dispersion machine, ball mill, vibrating ball mill, sand mill, attrition mill, roll mill and liquid collision type high speed dispersion machine. Examples of the charge generating material used include selenium-tellurium, pyrylium or thiapyrylium dyes and a variety of pigments such as phthalocyanine, anthoanthrone, dibenzpyrene quinone, triazo, cyanine, bisazo, monoazo, indigo, quinacridone and non-symmetric quinocyanine pigments. The polyphenylene resin according to the present invention may be used as the binder resin when the charge generating layer serves as When the charge generation layer does not serve as a surface layer, a variety of resins may used as the binder resin. It is preferable that the thickness of the charge generating layer is 5 $\mu$m or less, more preferably 0.1 to 2 $\mu$m.

The photosensitive layer can be formed by coating, followed by drying, a solution prepared by dispersing and/or dissolving the charge generating material and charge transfer material in the binder resin when the photosensitive layer is of a monolayer type. Preferable thickness is in the range of 5 to 40 $\mu$m, more preferably 15 to 30 $\mu$m.

The protective layer can be formed by coating, followed by drying, a solution containing the polyphenylene resin according to the present invention and, if necessary, an organic or inorganic resistance controlling agent. The thickness of the protective layer is preferably 0.5 to 10 $\mu$m, more preferably 1 to 5 $\mu$m.

Any conductive materials may be used for the supporting member and typical examples include a metal, such as aluminum and stainless steel, or a metal, paper or plastic provided in a conductive layer with a sheet or cylindrical configuration.

A conductive layer may be provided between the supporting member and photosensitive layer in the present invention for the purpose of prevention of interference patterns or coating of flaws on the supporting member. Such protective layers can be formed by coating a solution prepared by dispersing conductive particles such as carbon black or metal oxide particles into the binder resin, followed by drying. The preferable thickness of the conductive layer is 5 to 40 $\mu$m, more preferably 10 to 30 $\mu$m.

An interlayer having an adhesion function and barrier function can be provided between the supporting member and photosensitive layer in the present invention. Examples of the materials for the interlayer include polyamide, polyvinyl alcohol, polyethylene oxide, ethyl cellulose, casein, polyurethane and polyether urethane. The interlayer can be formed by coating, followed by drying, a solution prepared by dissolving the foregoing materials in an appropriate solvent. The preferable thickness of the interlayer is 0.05 to 5 $\mu$m, more preferably 0.3 to 1 $\mu$m.

The FIGURE shows an illustrative construction of a process cartridge having an electrophotographic photosensitive member according to the present invention.

In the FIGURE, the reference numeral 1 corresponds to a drum-shaped electrophotographic photosensitive member according to the present invention that is driven by rotating around the center axis 2 along the direction indicated by the arrow at a prescribed speed. The photosensitive member 1 is uniformly charged with a given positive or negative potential around it with a primary charging means 3, followed by being exposed to an exposing light 4 from an exposing means (not shown in the FIGURE) such as a slit exposure or a laser beam scanning exposure. Electrostatic latent images are thus successively formed on the peripheral surface on the photosensitive member 1.

The electrostatic latent images formed are then developed with a toner at a development means 5. The toner developed images are successively transferred to a transfer member 7, fed from a paper feeder (not shown in the drawing) to a space between the photosensitive member 1 and transfer means 6 in synchronization with rotation of the photosensitive member 1, with the transfer means 6.

After image transfer, the transfer member 7 is separated from the surface of the photosensitive member, introduced into an image development means 8 and duplicated matters (copies) are printed out of the apparatus after image development.

The surface of the photosensitive member 1 after image transfer is cleaned by eliminating residual toner after transfer with a cleaning means 9, and after the de-charging treatment with a pre-exposing light 10 from a pre-exposing means (not shown in FIGURE), and the photosensitive member is repeatedly used for forming images. When the primary charging means 3 is a contact charging means using, for example, a charging roller, the pre-exposure is not always required.

A plurality of the construction elements among the electrophotographic photosensitive member 1, primary charging means 3, development means 5 and cleaning means 9 may be integrated into a process cartridge and this process cartridge may be constructed so as to be attachable to and detachable from the main frame of the electrophotographic apparatus such as a copy machine or a beam printer. For example, at least one of the primary charging means 3, development means 5 and cleaning means 9 are held to be integrated with the photosensitive member 1 into a cartridge to construct a process cartridge 11 that is attachable to and detachable from the main frame of the apparatus using a guide means such as rails 12 on the main frame.

The exposing light 4 is a reflection light or transmitted light from an original document, or a light irradiated by scanning a laser beam or by driving a LED array or a liquid crystal shutter array in response to signals generated by reading the original document with a sensor when the electrophotographic apparatus is a copy machine or a printer.

The electrophotographic photosensitive member according to the present invention is not only utilized for an electrophotographic copy machine but also widely used in the field of electrophotography such as a laser beam printer, CRT printer, LED printer, liquid crystal printer and laser printing process.

The present invention will be described hereinafter in more detail referring to the examples. The term "part(s)" in the examples refers to "part(s)" by weight.

EXAMPLE 1

An aluminum cylinder with a dimension of 30 mm (diameter)×357 mm (length) was coated with a solution composed of the following materials by a dip-coating method to form an electroconductive layer with a thickness of 15 $\mu$m by curing at 140° C. for 30 minutes.

Electroconductive Pigment:

$SnO_2$ coating treatment barium sulfate 10 parts

Resistance control pigment: Titanium oxide 2 parts

Binder resin: Phenol resin 6 parts

Levelling agent: Silicone oil 0.001 parts

Solvent: Methanol/methoxypropanol=0.2/0.8 20 parts

Then, a solution prepared by dissolving 3 parts of N-methoxymethylated nylon and 3 parts of nylon copolymer in 65 parts of methanol and 30 parts of n-butanol was coated by a dip-coating method, followed by drying, to form an interlayer with a thickness of 0.5 $\mu$m.

A solution prepared by mixing 4 parts of oxytitanium phthalocyanine, having strong diffraction peaks at Bragg's angles (2θ±0.2°) of 9.0°, 14.2°, 23.9° and 27.1° in the CuKα characteristic X-ray diffraction, 2 parts of polyvinyl(p-fluorine)benzal and 60 parts of cyclohexanone was dispersed with a sand mill using glass beads with a diameter of 1 mm, preparing a dispersion solution for the charge generation layer by adding 100 parts of ethyl acetate thereafter. This solution was coated on an interlayer by a dip-coating method followed by drying, thereby forming a charge generating layer with a thickness of 0.2 $\mu$m.

Then, 9 parts of a triallyl amine represented by the following formula (3), 1 part of a stylbene compound represented by the following formula (4) and 12.5 parts of a polyphenylene resin (Mw≈50,000) having a structural unit represented by the following formula (5) were dissolved in a mixed solvent of 50 parts of monochlorobenzene and 50 parts of dichloromethane.

(3)

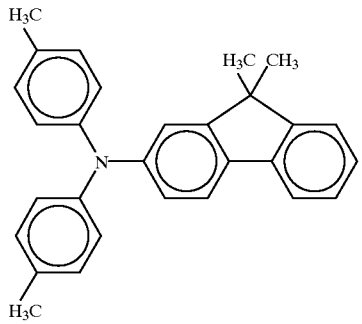

-continued (4)

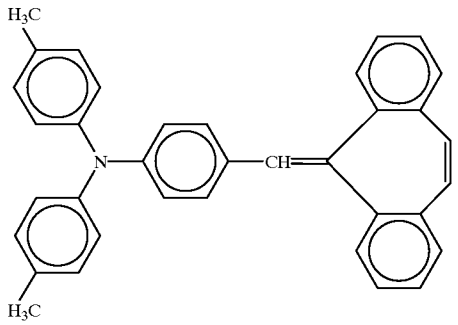

(5)

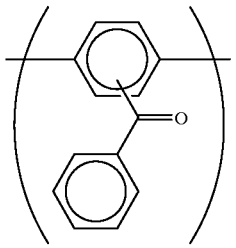

This solution was coated on the charge generating layer by a dip-coating method and, after drying at 110° C. for 1 hour, a charge transfer layer with a thickness of 23 $\mu$m was formed.

The electrophotographic photosensitive member prepared was attached to a copy machine GP-215 {made by Canon Inc.; equipped with a roller contact charging means in which DC voltages are superimposed on AC voltages (AC/DC contact charging means)} and the dark potential Vd, sensitivity EΔ500 and residual potential Vr were measured under an ordinary temperature and humidity of a temperature of 23° C. and a relative humidity of 50%. The copy machine GP-215 was reconstructed for measuring the electrophotographic characteristics of the photosensitive member.

The dark potential Vd indicates that the larger its absolute value is, the better becomes the charging ability while the sensitivity EΔ500 shows that the smaller the luminous energy required for attenuating the potential from −700 V to −200 V is, the higher the sensitivity.

A paper feed durability test against 50,000 sheets of paper feed was further carried out under ordinary temperature and humidity to measure the dark potential Vd, the sensitivity EΔ500 and the residual potential Vr after feeding 30,000 and 50,000 sheets of paper. The amount of abrasions after 30,000 and 50,000 sheets of paper feed were also determined. The durability test was performed by an intermittent mode to halt for every paper feed. The amount of abrasion was measured using an eddy current type film thickness measuring instrument (Permascope type E111 made by Fisher Co.).

Presence of solvent crack was confirmed by a microscopic observation by allowing the photosensitive member to stand for 48 hours after adhering the hand grease on the surface. The mark (o) in the table shows that no solvent crack is observed and the mark (x) shows the presence of the solvent crack. The results are listed in TABLE 1.

EXAMPLE 2

The photosensitive member was prepared and evaluated by the same method as in Example 1, except that the polyphenylene resin (Mw≈40,000) having the structural unit represented by the following formula (6) was used as a binder resin for use in the charge transfer layer.

(6)

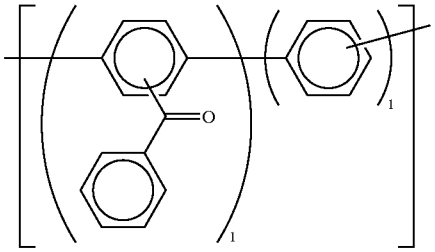

The results are listed in TABLE 1.

EXAMPLE 3

The photosensitive member was prepared and evaluated by the same method as in Example 1, except that the polyphenylene resin having the structural unit (2) was used as the binder resin for use in the charge transfer layer.

The results are listed in TABLE 1.

EXAMPLE 4

The photosensitive member was prepared and evaluated by the same method as in Example 1, except that a mixture of the polyphenylene resin used in Example 1 and a polycarbonate resin (Iupilon Z-200, Made by Mitsubishi Engineering Plastics Co.) in 1:1 weight ratio was used as a binder for use in the charge transfer layer.

The results are listed in TABLE 1.

Comparative Example 1

The photosensitive member was prepared and evaluated by the same method as in Example 1, except that only a polycarbonate resin (Iupilon Z-200, Made by Mitsubishi Engineering Plastics Co.) was used as a binder for use in the charge transfer layer.

The results are listed in TABLE 1.

TABLE 1

| | Initial | | | After 30,000 sheets of feed | | | | After 50,000 sheets of feed | | | | Solvent crack resistance | |
|---|---|---|---|---|---|---|---|---|---|---|---|---|---|
| | Vd (−V) | Vr (−V) | EΔ500 (μJ/cm²) | Vd (−V) | Vr (−V) | EΔ500 (μJ/cm²) | Amount of abrasion (μm) | Vd (−V) | Vr (−V) | EΔ500 (μJ/cm²) | Amount of abrasion (μm) | 24 hrs | 48 hrs |
| Example 1 | 720 | 30 | 0.40 | 710 | 35 | 0.42 | 4.0 | 700 | 35 | 0.43 | 7.0 | ○ | ○ |
| Example 2 | 720 | 30 | 0.42 | 720 | 35 | 0.43 | 4.0 | 710 | 40 | 0.43 | 6.8 | ○ | ○ |
| Example 3 | 710 | 30 | 0.41 | 700 | 30 | 0.42 | 4.2 | 700 | 40 | 0.42 | 7.1 | ○ | ○ |
| Example 4 | 710 | 20 | 0.43 | 710 | 30 | 0.44 | 4.8 | 690 | 30 | 0.45 | 8.2 | ○ | ○ |
| Comparative Example 1 | 700 | 20 | 0.43 | 690 | 25 | 0.45 | 8.4 | * | * | * | 16 | ○ | X |

*These values were not measured because it was not possible to impart a sufficient amount of charge.

EXAMPLE 5

The photosensitive member prepared in Example 1 was attached to a reconstructed laser beam printer "Laser Jet 4 Plus (made by Hewlett-Packard Co.)" equipped with an AC/DC contact charging means and was subjected to a 3,000 sheets of paper feed durability test under ordinary temperature and humidity to determine the amount of abrasion. Image qualities after the durability test was also visually evaluated. Afterward, the paper feed durability test was continued in a high temperature/high humidity environment of a temperature of 35° C. and a relative humidity of 85% until some problems occurred in the image quality. When the toner was used up during the test, the toner was replenished to permit the test to continue. The printer was reconstructed so that the peak to peak charging voltage for the primary charging is increased by 20%.

The durability test was performed by an intermittent mode to halt for every paper feed. The amount of abrasion was measured using an eddy current type film thickness measuring instrument (Permascope type E111 made by Fisher Co.).

The results are listed in TABLE 2.

EXAMPLE 6

The photosensitive member prepared in Example 2 was evaluated by the same method as in Example 5.

The results are listed in TABLE 2.

Comparative Example 2

The photosensitive member prepared in Comparative Example 1 was evaluated by the same method as in Example 5.

The results are listed in TABLE 2.

EXAMPLE 7

The photosensitive member prepared in Example 1 was attached to a copy machine "GP-55 (made by Canon Co.)" equipped with a corona charging means and was subjected to a 30,000 sheets of paper feed durability test under ordinary temperature and humidity to determine the amount of abrasion. Image qualities after the durability test were also visually evaluated. Afterward, the paper feed durability test was continued in a high temperature/high humidity environment of a temperature of 35° C. and a relative humidity of 85% until some problems occurred in the image quality. When the toner was used up during the test, the toner was replenished to permit the test to continue.

The durability test was performed by an intermittent mode to halt for every paper feed. The amount of abrasion was measured using an eddy current type film thickness measuring instrument (Permascope type E111 made by Fisher Co.).

The results are listed in TABLE 2.

EXAMPLE 8

The photosensitive member prepared in Example 2 was evaluated by the same method as in Example 7.

The results are listed in TABLE 2.

Comparative Example 3

The photosensitive member prepared in Comparative Example 1 was evaluated by the same method as in Example 7.

The results are listed in TABLE 2.

EXAMPLE 9

An electroconductive layer and interlayer was formed on an aluminum cylinder by the same method as in Example 1.

After dispersing a solution prepared by mixing 4 parts of an azo dye represented by the following formula (7), 2 parts of polyvinyl(p-fluorine)benzal and 120 parts of tetrahydrofurane for 20 hours in a sand mill using glass beads with a diameter of 1 mm, a dispersion solution for use in the charge generating layer was prepared by adding 70 parts of cyclohexanone. This solution was coated on the intermediate layer by a dip-coating method to form a charge generating layer with a thickness of 0.3 μm after drying.

(7)

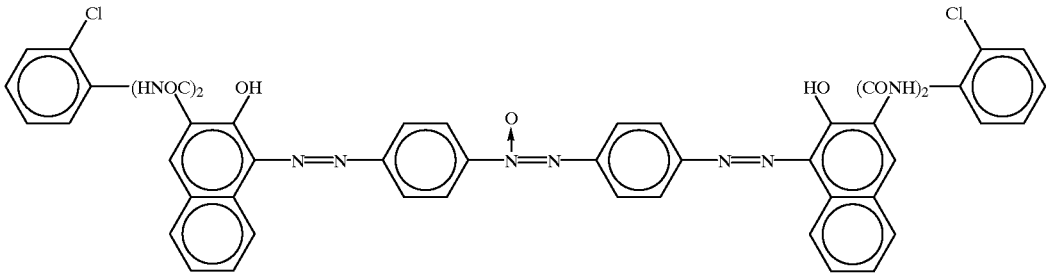

A charge transfer layer was then formed by the same method as in Example 1, except that a polyphenylene resin with a weight average molecular weight of 20,000 was used.

The photosensitive member was attached to a copy machine "NP-6030 {made by Canon Inc.; equipped with a roller contact charging means in which DC voltages (DC contact charging means)}" equipped with a roller contact charging means and was subjected to a 30,000 sheets of paper feed durability test under the ordinary temperature and humidity to determine the amount of abrasion. Image qualities after the durability test were also visually evaluated. Afterward, the paper feed durability test was continued in a high temperature/high humidity environment of a temperature of 35° C. and a relative humidity of 85% until some problems occurred in the image quality. When the toner was used up during the test, the toner was replenished to permit the test to continue.

The durability test was performed by an intermittent mode to halt for every paper feed. The amount of abrasion was measured using an eddy current type film thickness measuring instrument (Permascope type E111 made by Fisher Co.).

EXAMPLE 10

A photosensitive member as prepared and evaluated by the same method as in Example 9, except that a polyphenylene resin (Mw≈60,000) with a structural unit represented by the following formula (8) was used as a binder resin for use in the charge transfer layer.

(8)

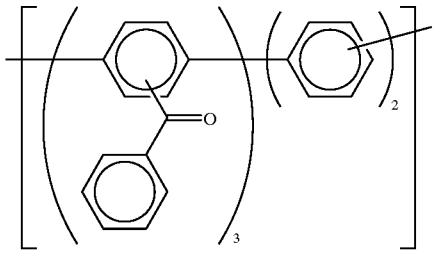

The results are listed in TABLE 2.

Comparative Example 4

A photosensitive member was prepared and evaluated by the same method as in Example 9, except that a polycarbonate resin (Iupilon Z-200, made by Mitsubishi Engineering Plastics Co.) was used instead of the polyphenylene resin.

The results are listed in TABLE 2.

TABLE 2

| | Charging means | Amount of abrasion (μm) | Image quality | Durability test |
|---|---|---|---|---|
| Example 5 | AC/DC contact charging | 1.6 | Good | Fogs appears after 23,000 sheets of feed |
| Example 6 | | 1.5 | Good | Fogs appears after 25,000 sheets of feed |
| Comparative Example 2 | | 4.5 | Good | Fogs appear after 8,500 sheets of feed |
| Example 7 | Corona charging | 3.0 | Good | Fogs appears after 90,000 sheets of feed |
| Example 8 | | 3.1 | Good | Fogs appears after 95,000 sheets of feed |
| Comparative Example 3 | | 5.4 | Good | Fogs appear after 65,000 sheets of feed |
| Example 9 | DC contact charging | 3.4 | Good | White lines appear after 100,000 sheets of feed |
| Example 10 | | 3.4 | Good | White lines appear after 110,000 sheets of feed |
| Comparative Example 4 | | 7.5 | Good | White lines appear after 55,000 sheets of feed |

From the results as hitherto described, it is evident that the electrophotographic photosensitive member using the polyphenylene resin according to the present invention is excellent in the electrophotographic characteristics and solvent crack resistance, and is especially excellent in durability in the systems with a large amount of current. These results show that the electrophotographic photosensitive member according to the present invention is excellent not only in the mechanical durability but also in the electrical durability.

What is claimed is:

1. An electrophotographic photosensitive member comprising: a substrate and a photosensitive layer formed on said substrate, a surface layer of said electrophotographic photosensitive member containing a polyphenylene resin, wherein said polyphenylene resin has a structural unit represented by the following formula (1):

(1)

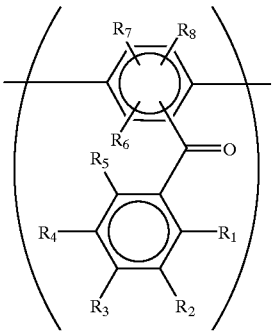

wherein $R_1$ to $R_5$ are the same or different and are each a hydrogen atom, a fluorine atom or a substituted or unsubstituted alkyl group, and $R_6$ to $R_8$ are the same or different and are each a hydrogen atom or a substituted or unsubstituted alkyl group.

2. An electrophotographic photosensitive member according to claim 1, wherein all of $R_6$ to $R_8$ are hydrogen atoms.

3. An electrophotographic photosensitive member according to claim 1, wherein all of $R_1$ to $R_8$ are hydrogen atoms.

4. An electrophotographic photosensitive member according to claim 1, wherein said polyphenylene resin has a structural unit represented by the following formula (2):

(2)

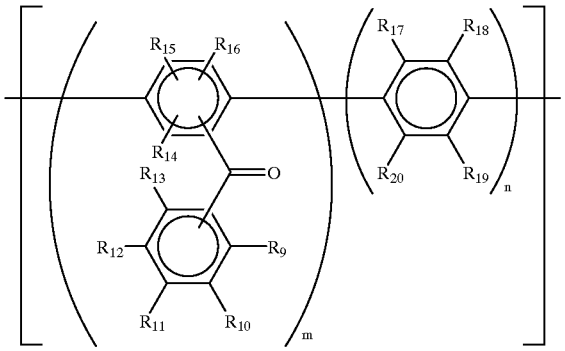

wherein $R_9$ to $R_{13}$ are the same or different and are each a hydrogen atom, a fluorine atom or a substituted or unsubstituted alkyl group, $R_{14}$ to $R_{20}$ are the same or different and are each a hydrogen atom or a substituted or unsubstituted alkyl group, and m and n represent copolymerization ratios, wherein m:n is 20:80-80:20.

5. An electrophotographic photosensitive member according to claim 4, wherein all of $R_{14}$ to $R_{20}$ are hydrogen atoms.

6. An electrophotographic photosensitive member according to claim 4, wherein all of $R_9$ to $R_{20}$ are hydrogen atoms.

7. An electrophotographic photosensitive member of claim 1, wherein the photosensitive layer is a monolayer containing a charge generating material and a charge transfer material and the surface layer is the monolayer.

8. An electrophotographic photosensitive member of claim 1, wherein the photosensitive layer comprises a charge transfer layer laminated to a charge generation layer, said charge generation layer spaced between the charge transfer layer and the substrate and the surface layer is the charge transfer layer.

9. An electrophotographic photosensitive member of claim 1, wherein the surface layer is a protective layer on said photosensitive layer.

10. A process cartridge comprising: an electrophotographic photosensitive member and, at least one of a charging means, a development means or a cleaning means, said electrophotographic photosensitive member and said at least one means being integrated to be supported so as to be freely attachable to and detachable from an electrophotographic apparatus, wherein said electrophotographic photosensitive member comprises a substrate and a photosensitive layer formed thereon, a surface layer of said electrophotographic photosensitive member containing a polyphenylene resin wherein said polyphenylene resin has a structural unit represented by the following formula (1):

(1)

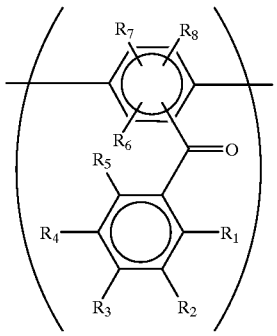

wherein $R_1$ to $R_5$ are the same or different and are each a hydrogen atom, a fluorine atom or a substituted or unsubstituted alkyl group, and $R_6$ to $R_8$ are the same or different and are each a hydrogen atom or a substituted or unsubstituted alkyl group.

11. A process cartridge according to claim 10, wherein all of $R_6$ to $R_8$ are hydrogen atoms.

12. A process cartridge according to claim 10, wherein all of $R_1$ to $R_8$ are hydrogen atoms.

13. A process cartridge according to claim 10, wherein said polyphenylene resin has a structural unit represented by the following formula (2):

(2)

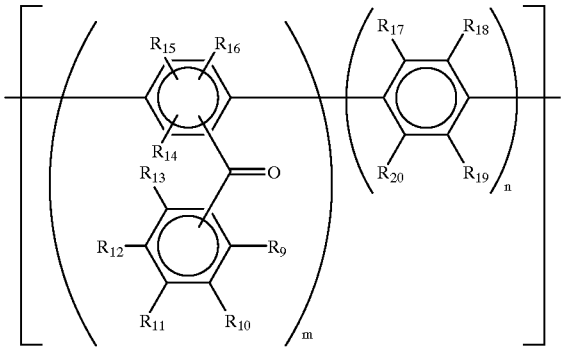

wherein $R_9$ to $R_{13}$ are the same or different and are each a hydrogen atom, a fluorine atom or a substituted or unsubstituted alkyl group, $R_{14}$ to $R_{20}$ are the same or different and are each a hydrogen atom or a substituted or unsubstituted alkyl group, and m and n represent copolymerization ratios, wherein m:n is 20:80-80:20.

14. A process cartridge according to claim 13, wherein all of $R_{14}$ to $R_{20}$ are hydrogen atoms.

15. A process cartridge according to claim 13, wherein all of $R_9$ to $R_{20}$ are hydrogen atoms.

16. An electrophotographic apparatus comprising: an electrophotographic photosensitive member, a charging means, a exposing means, a development means and a transfer means, wherein said electrophotographic photosensitive member comprises a substrate and a photosensitive layer formed thereon, a surface layer of said electrophotographic photosensitive member containing a polyphenylene resin, wherein said polyphenylene resin has a structural unit represented by the following formula (1):

(1)

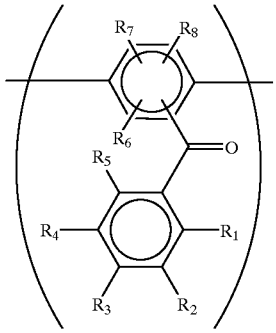

wherein $R_1$ to $R_5$ are the same or different and are each a hydrogen atom, a fluorine atom or a substituted or unsubstituted alkyl group, and $R_6$ to $R_8$ are the same or different and are each a hydrogen atom or a substituted or unsubstituted alkyl group.

17. An electrophotographic apparatus according to claim 16, wherein all of $R_6$ to $R_8$ are hydrogen atoms.

18. An electrophotographic apparatus according to claim 16, wherein all of $R_1$ to $R_8$ are hydrogen atoms.

19. An electrophotographic apparatus according to claim 16, wherein said polyphenylene resin has a structural unit represented by the following formula (2):

(2)

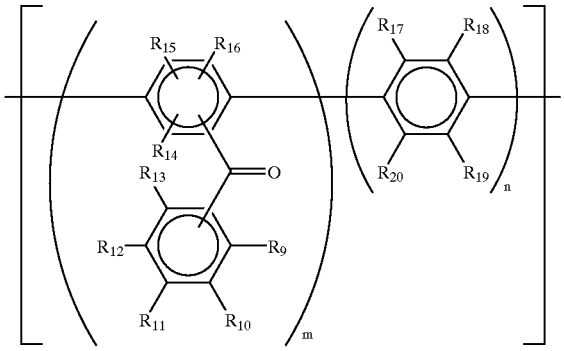

wherein $R_9$ to $R_{13}$ are the same or different and are each a hydrogen atom, a fluorine atom or a substituted or unsubstituted alkyl group, $R_{14}$ to $R_{20}$ are the same or different and are each a hydrogen atom or a substituted or unsubstituted alkyl group, and n and m represent copolymerization ratios, wherein m:n is 20:80 to 80:20.

20. An electrophotographic apparatus according to claim 19, wherein all of $R_{14}$ to $R_{20}$ are hydrogen atoms.

21. An electrophotographic apparatus according to claim 19, wherein all of $R_9$ to $R_{20}$ are hydrogen atoms.

* * * * *

UNITED STATES PATENT AND TRADEMARK OFFICE

CERTIFICATE OF CORRECTION

PATENT NO. : 6,180,302 B1 
DATED : January 30, 2001
INVENTOR(S) : Takakazu Tanaka et al.

It is certified that error appears in the above-identified patent and that said Letters Patent is hereby corrected as shown below:

Column 2,
Line 41, “containing” should read -- which contains --.

Column 4,
Line 24, “and m” should be deleted; and
Line 48, “more.” should read -- more based on the total weight of the resin in the surface layer. --

Column 9,
Line 62, “Layer” should read -- layer --.

Column 10,
Line 36, “as” should read -- as a surface layer. --; and
Line 53, “materials” should read -- material --.

Column 11,
Line 38, “after trans-” should be deleted; and
Line 39, “fer” should be deleted.

Column 18,
Table 2, “Fogs appear” (six occurrences) should read -- Fog appears --.

Signed and Sealed this

Seventeenth Day of June, 2003

JAMES E. ROGAN
*Director of the United States Patent and Trademark Office*